United States Patent [19]

Günther

[11] Patent Number: 4,641,508

[45] Date of Patent: Feb. 10, 1987

[54] LOCK WITH BOLT ENLARGEMENT

[75] Inventor: Dieter Günther, Berlin, Fed. Rep. of Germany

[73] Assignee: Zeiss Ikon Aktiengesellschaft, Fed. Rep. of Germany

[21] Appl. No.: 758,823

[22] Filed: Jul. 25, 1985

[30] Foreign Application Priority Data

Jul. 28, 1984 [DE] Fed. Rep. of Germany ..... 3427970

[51] Int. Cl.[4] ..... E05B 17/04

[52] U.S. Cl. ..... 70/380; 70/143

[58] Field of Search ..... 70/143, 379 R, 379 A, 70/380

[56] References Cited

U.S. PATENT DOCUMENTS 830,014 9/1906 Shaw ..... 70/380

1,639,144 8/1927 Muzzio ..... 70/380

2,155,726 4/1939 Machinist ..... 70/380

*Primary Examiner*—Robert L. Wolfe

*Attorney, Agent, or Firm*—Hill, Van Santen, Steadman & Simpson

[57] ABSTRACT

There is disclosed herein a lock mechanism having a lengthened bolt path which is compact and exhibits an increased mechanical efficiency. The lock includes a cylinder having a rotatable lock beard and a ring surrounding said cylinder for rotation upon engagement by the lock beard. A stop on the outer circumference of the ring engages a bolt notch formed in a bolt and tumbler plate. The lock beard, the ring and the bolt and tumbler plate lie in the same plane. The radius described by rotation of the lock beard is less than the distance between the rotational axis of the lock beard and the sides of the bolt notch.

3 Claims, 1 Drawing Figure

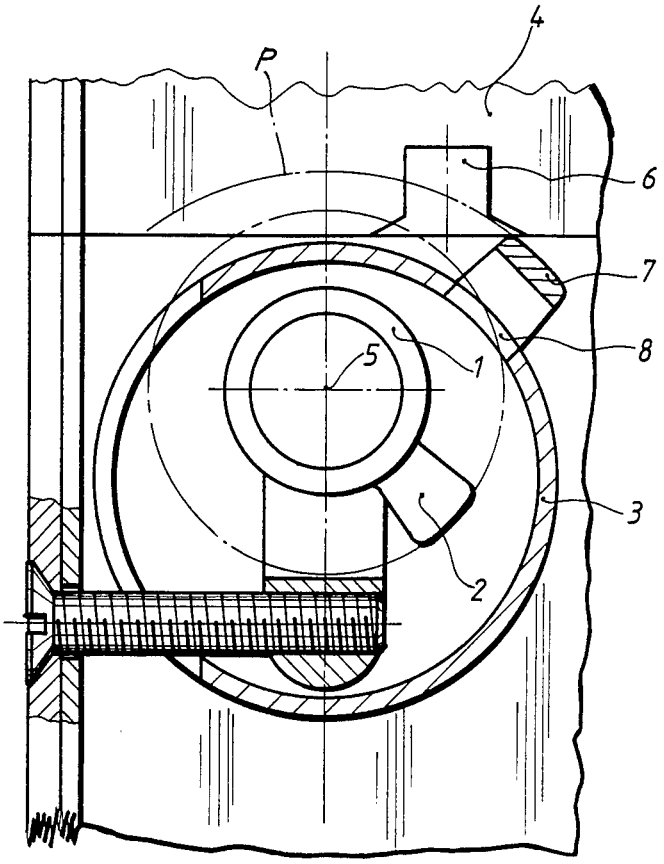
4
P
6
7
8
5
1
3
2

LOCK WITH BOLT ENLARGEMENT

BACKGROUND OF THE INVENTION

This invention relates to a mechanical lock, and more particularly, to a mechanism for increasing the bolt path for the lock.

The "throw" of a lock bolt is the distance in one direction of a reciprocating part. Thus, the "throw" or the effective length of the path for a single turn lock is about 13 mm. This is inadequate in many uses to effect an adequately deep penetration of the bolt into the door frame. For this reason a number of solutions for creating a longer throw or longer bolt path has been disclosed. For example, multi-turn locks.

It is also known to increase the rotation of the lock cylinder, and thus the effective radius described by the lock beard, by means of a gear or lever transmission in order to lengthen the bolt path.

Furthermore, it is also known to surround the lock cylinder and lock beard, with mutually connected ring wheels which are rotatable therearound. The outermost ring wheel at one side includes a plurality of coaxially disposed stops. By rotating the lock beard and thus the ring wheel, the stops can be brought into engagement with bolt notches at the tumbler plate. The tumbler plate is positioned in a plane parallel to the plane in which the lock beard rotates. A lengthening of the bolt path is achieved by lengthening the radius between the lock cylinder and bolt as described.

The disadvantage in using such mutually connected ring wheels and the gear or lever transmissions is the relatively great mechanical outlay needed to operate the lock and the structural size of the lock which is produced.

The object of this invention is to provide a lock which produces a bolt path of more than 13 mm with a single turn.

Another object of this invention is to provide a lock which is mechanically efficient and which is of a efficient size.

These and other objects of this invention will become apparent from the following disclosure and appended claims.

SUMMARY OF THE INVENTION

The invention herein resides in providing an extremely compact lock having a lengthened bolt path and increased mechanical efficiency. In this lock the bolt and the tumbler plate can remain in the plane of the lock beard despite the lengthened bolt path. Furthermore, different profile lock cylinders can be used in this lock.

BRIEF DESCRIPTION OF THE DRAWING

The single FIGURE on the drawing is a cross-sectional view with parts shown schematically through a lock embodying the features of the present invention.

DESCRIPTION OF THE PREFERRED EMBODIMENT

The lock includes a standard profile cylinder 1, having a lock beard 2, which is rotatable about the cylinder axis 5. A ring 3, which surrounds the lock cylinder 5, is provided and is rotated by the lock beard 2. The ring includes a notch 8 for engagement by the lock beard 2 when the notch 8 is in the upper range of the ring's rotational circle. The radius described by the lock beard 2 is less than the distance between the rotational axis 5 of the lock cylinder and the parallel sides of the bolt notch 6. Thus the bolt is not actuated by the lock beard 2 itself.

A stop 7, shaped as an additional lock beard, is provided on the outside circumference of the ring 3. The stop 7 engages the bolt notch 6 when the ring 3 is engaged by and moved by the lock beard 2. The bolt path is thus defined as a function of the movement of the stop 7 on the path P, and the path can be lengthened by appropriate dimensioning. The length of the bolt path is dependent on the radii as defined by the dimensions. It is to be noted that the lock beard, ring and bolt and tumbler all lie in the same plane.

The radius of rotation of the lock beard 2 is shown on the drawing for the purpose of comparison in order to illustrate the different ranges of the moving circle for the lock beard 2 and stop 7 that are available for the bolt thrust, i.e., the "throw" of the bolt. It will be understood, of course, that a bolt is provided as at 4, which is a reciprocating element movable in a path in and out of the door frame. Various modifications with respect to the distance of the rotational axes from the bolt notch 6 may be achieved without departing from the spirit of the invention.

Although the invention has been described with respect to preferred embodiments, it is not to be so limited as changes and modifications can be made which are within the full intended scope of the invention as defined by the appended claims.

I claim as my invention:

1. A lock having:

a lock beard;

a rotatable ring surrounding said lock beard, said ring having a recess for engagement by said lock beard, whereby said ring rotates with said lock beard upon engagement therewith;

a stop formed on said ring;

a bolt having a tumbler plate and said tumbler plate having a notch formed therein for cooperation with the stop formed on said ring;

said lock characterized in that:

said lock beard, said ring and said bolt and tumbler plate all lie in one plane;

the radius described by said lock beard upon rotation is less than the distance between the rotational axis of the lock beard and the parallel sides of the bolt notch in said tumbler plate;

said stop is provided on the outside circumference on said ring and is engageable with said bolt notch;

a rotatable lock cylinder having said lock beard therein, said cyclinder rotatable about said rotational axis; and said ring surrounding said lock cylinder being rotatable about a different axis.

2. An improved lock as in claim 1, wherein said bolt moves along a bolt path that is greater than 13 mm in length.

3. An improved lock as in claim 1 and further characterized by:

said ring being of enlarged diameter relative to said cylinder and having a notch engageable with said lock beard when the notch is in a predetermined range of its rotational circle;

said ring having a stop formed as an additional lock beard on its outer periphery and being engageable with a notch formed in the bolt, thereby to drive the bolt through a throw of increased dimensions for effecting deeper penetration of an adjoining door frame.

* * * * *